US005085019A

United States Patent [19]

van Herpen

[11] Patent Number: 5,085,019

[45] Date of Patent: Feb. 4, 1992

[54] DOOR, WINDOW OR PANEL SECTION

[75] Inventor: Frederik C. van Herpen, Burgh Haamstede, Netherlands

[73] Assignee: Aiprokon Promotie & Ontwilleling B.V., Holland, Netherlands

[21] Appl. No.: 613,077

[22] Filed: Nov. 14, 1990

[30] Foreign Application Priority Data

Nov. 16, 1989 [NL] Netherlands ..... 8902841

[51] Int. Cl.[5] ..... E05C 5/00

[52] U.S. Cl. ..... 52/127.1; 292/57

[58] Field of Search ..... 52/127.1; 292/57, 39

[56] References Cited

U.S. PATENT DOCUMENTS

| | | | |
|---|---|---|---|
| 2,757,419 | 8/1956 | Balintfi . | |
| 3,140,671 | 7/1964 | Kozak et al. | 292/57 |
| 3,984,133 | 10/1976 | Dathe et al. | 292/57 |
| 4,754,624 | 7/1988 | Fleming et al. | 292/39 |

FOREIGN PATENT DOCUMENTS

| | | | |
|---|---|---|---|
| 226797 | 7/1987 | European Pat. Off. | 292/57 |
| 168434 | 2/1905 | Fed. Rep. of Germany . | |
| 320879 | 5/1920 | Fed. Rep. of Germany . | |
| 3327547 | 3/1985 | Fed. Rep. of Germany . | |
| 2288841 | 5/1986 | France | 292/57 |
| 7018166 | 7/1971 | Netherlands . | |
| 7110529 | 2/1973 | Netherlands . | |
| 775346 | 5/1957 | United Kingdom . | |
| 2169023 | 7/1986 | United Kingdom . | |

*Primary Examiner*—Eric K. Nicholson

*Attorney, Agent, or Firm*—Ostrolenk, Faber, Gerb & Soffen

[57] ABSTRACT

Door- or panel section with an extruded elongate housing with C-shaped cross-section, side legs and facing end edges the central parts of the inside of the body, of the two side legs and of the end edges of the cross-section having a surface rounded according to an unscribed circle for housing a closing element, the faces adjoining them enclosing a right angle.

18 Claims, 9 Drawing Sheets

DOOR, WINDOW OR PANEL SECTION

BACKGROUND OF THE INVENTION

The invention relates to a door, window or panel section, comprising an elongated housing manufactured by extrusion and having a C-shaped cross-section, with end edges which face each other going out from the two side legs thereof for the purpose of accommodating a closing element.

Such sections to be fitted against either a flat side or against the end edge are known in many embodiments; examples of the latter sort are described in Dutch Patent Specifications 140316, 148678 and 174857. They are manufactured by extrusion and are also suitable, for example, for the accommodation therein of a closing or locking element.

SUMMARY OF THE INVENTION

An object of the invention is to provide such a section which is very universally usable, which in particular, through the shape of the cross-section proposed according to the invention, can be extruded with a minimum use of material, and in which the strength remains adequate despite the saving in material achieved.

The above object is achieved in that the central parts of the insides of the body, of the two side legs and of the end edges of this cross-section have a surface rounded according to an inscribed circle, the faces adjoining it enclose a right angle, and at least one flange extends from the housing.

The configuration proposed according to the invention has the advantage that closing and locking elements with either a cylindrical or a rectangular cross-section configuration can be used in the section.

Preferably this measure not only leads to a saving of material, but also facilitates the working of the interior of the section with, for example, a milling cutter, as is necessary for making recesses for the accommodation of a day and/or night bolt. In a preferred embodiment, the outside of the body is raised outwards over a part of the width thereof until past the end edge of one of the legs, in order to form a nesting face for a closing plate fitting with spaced around the housing, and the other leg is extended outwards with a chamfered part to obtain a stop for the closing plate and a run-up edge for a day bolt, a recess running in the lengthwise direction being formed in one of the side walls to accommodate a catch connected to a closing element to be placed in the section.

These measures provide a lock which is easy to operate, the advantage being that the distance along which the locking pin can be moved can be considerably greater than the limited distance which can be bridged with the usual flush sliding bolt (for example, of the type which is the subject of Dutch patens 148678 and 174857). The latter arises from the fact that in a flush sliding bolt the shaped locking element is formed by chamfering an extruded, shaped length of material which during extrusion can have only a limited width. If desired, it is still possible to use a flush sliding bolt locking element in the section according to the invention.

Preferably, the locking element comprises a locking pin formed by a hollow bushing with a core of hard material. This embodiment has the advantage that not only has sawing through the part of the locking pin projecting beyond the section becomes particularly impossible, but it is also no longer necessary when the section forms part of a door pin section, to make this section to size in the workshop: it is sufficient to deliver a section with locking pin, but without insert pin, longer than the expected working height, to make the section to size, and thereafter to fit the hardened pin.

The section and the lock according to the invention are very universally usable and can be used, for example, also for setting up temporary or provisional partitions quickly.

DESCRIPTION OF THE FIGURES

The invention will be described in greater detail in the following Detailed Description, with reference to the Drawings, in which.

DETAILED DESCRIPTION OF PREFERRED EMBODIMENTS

Figure 2:
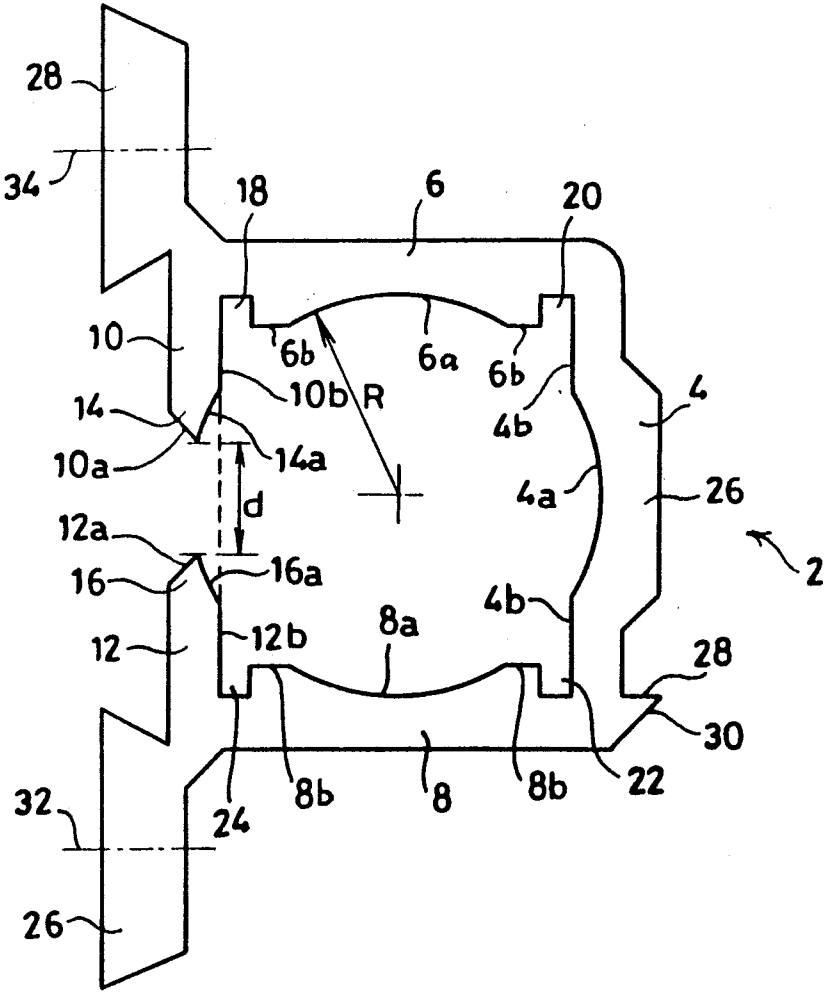
FIG. 2 is a cross-section along the line II—II in FIG. 1.
Figure 1:
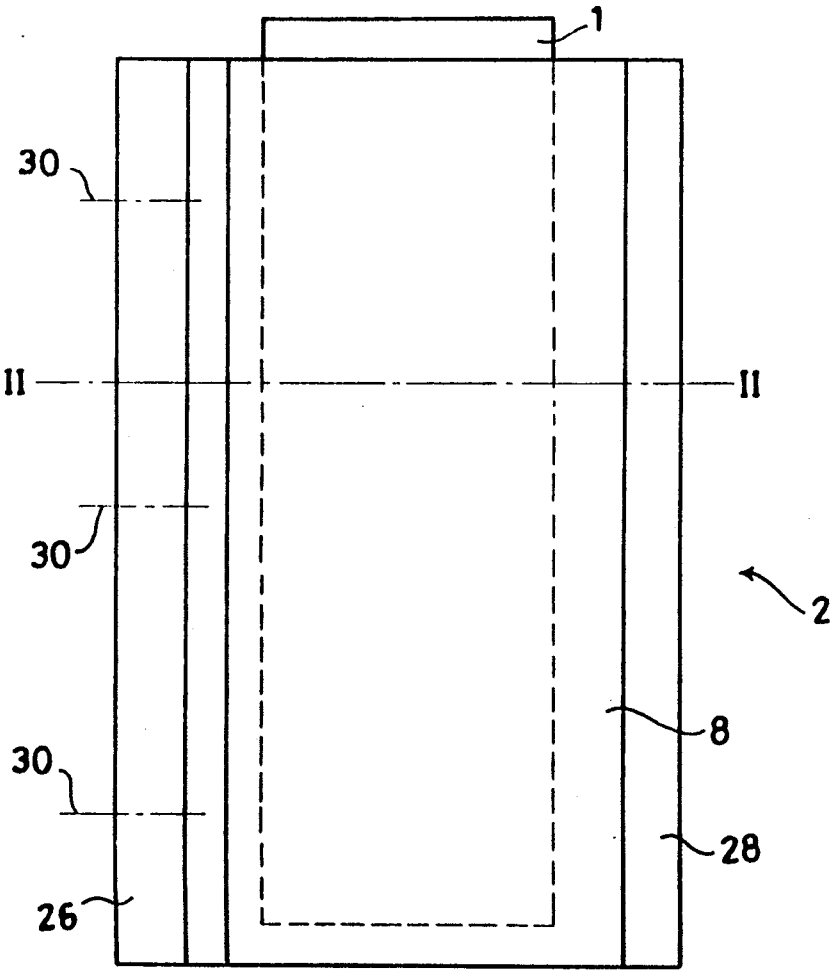
FIG. 1 is a side view of section according to the invention.

FIG. 1 shows a side view, and FIG. 2 a cross-section along the line II—II in FIG. 1 of the housing according to the invention. This housing 2 is manufactured in a standard length by extrusion and chamfered to the correct length, and has a very special configuration which can best be seen from the cross-section according to FIG. 2.

This configuration is essentially C-shaped with a body part 4, two side legs 6, 8 going out from it, and end edges 10, 12 respectively going out from said sides legs and facing each other. This measure produces a considerable material saving, and thus also cost saving. In the embodiment shown, the longitudinal edges of these end edges 10, 12 are also chamfered in a pointed shape in order to save material, as indicated by 10*a* and 12*a* respectively; the points lie at a distance (d) from each other. This distance (d) can be selected depending on the purpose for which the housing is used; an embodiment in which this distance (d) is reduced to zero and the points 10*a*, 12*a* touch each other also lies within the scope of the invention. Of course, the saving of material achieved is then lower, while the extrusion is more expressive, due to the necessary complex mold.

The housing is intended for the accommodation of an elongated closing element 1 for sliding in the lengthwise direction of the housing, and shown schematically in FIG. 1; this closing element can be either a locking pin or a control element for a locking pin. The object of the invention is to provide the possibility for use of either a closing element which is circular in cross-section or a closing element which is rectangular in cross-section, and to this end the inside of the body part 1, the legs 6 and 8 and the end edges 10, 12 are formed in a special way. The central part 4*a* of the inside of the body part 4, the central part 6*a* of the inside of the leg 6, the central part 8*a* of the inside of the leg 8, the inside 14*a* of the area 14 and the inside 16*a* of the area 16 are rounded off according to an inscribed circle with radius R. The housing can thus accommodate a rectangular closing element or locking pin with a diameter slightly smaller than this radius R. It is, however, also possible for the housing to accommodate a rectangular closing element therein, because flat parts are formed adjacent to these rounded parts, indicated by 4*b* for the body 4, 6*b* for the leg 6, 8*b* for the leg 8, and 10*b*, 12*b* respectively for the edges 10, 12, which together provide retaining faces for a rectangular closing element.

As already said, it is very important when extruding sections from light metal, in particular aluminum, to use as little material as possible while retaining the desired mechanical properties. To this end, the flat surface parts 6*b*–10*b*, 6*b*–4*b*, 4*b*–8*b*, 8*b*–12*b*, thus in fact the corners of the locating nest formed, do not adjoin each other directly, but recess 18, 20, 22 and 24 are formed in these corners, each of such dimensions that a good compromise is obtained between the envisaged saving in material and the necessary material thickness for extrusion and strength.

The body part 4 in the embodiment shown has a raised part 26, while the leg 8 continues into a projecting edge 28 provided with the chamfer 30. The object of these provisions will now be explained further below.

Finally, the housing is also provided with at least one flange facing away from the housing; in the embodiment shown there are two such flanges, indicated by 26, 28, in which fixing holes 32, 34, indicated schematically, can be formed.

The housing described above is an independent part which can be fixed on a suitable base by means of fixing devices going through the flanges 26, 28. An intersecting application of the structure described is, however, that in which the housing is integrated in a door pin section which is known per se, for example, a section of the type known from Dutch Patent Specification 148678. FIGS. 3 to 12 relate to such an embodiment.

Figure 3:
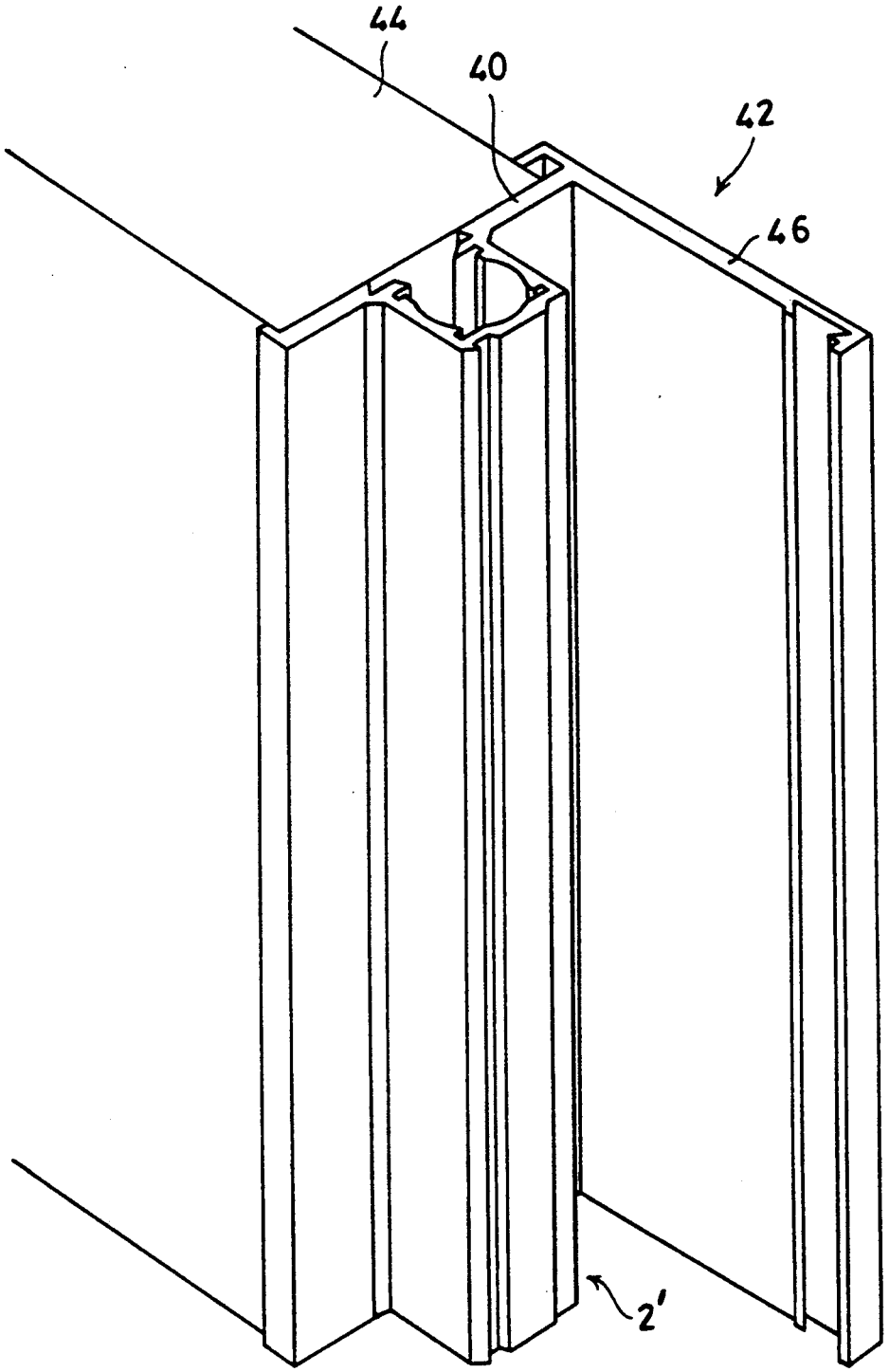
FIG. 3 is a perspective view of a section according to the invention.
Figure 4:
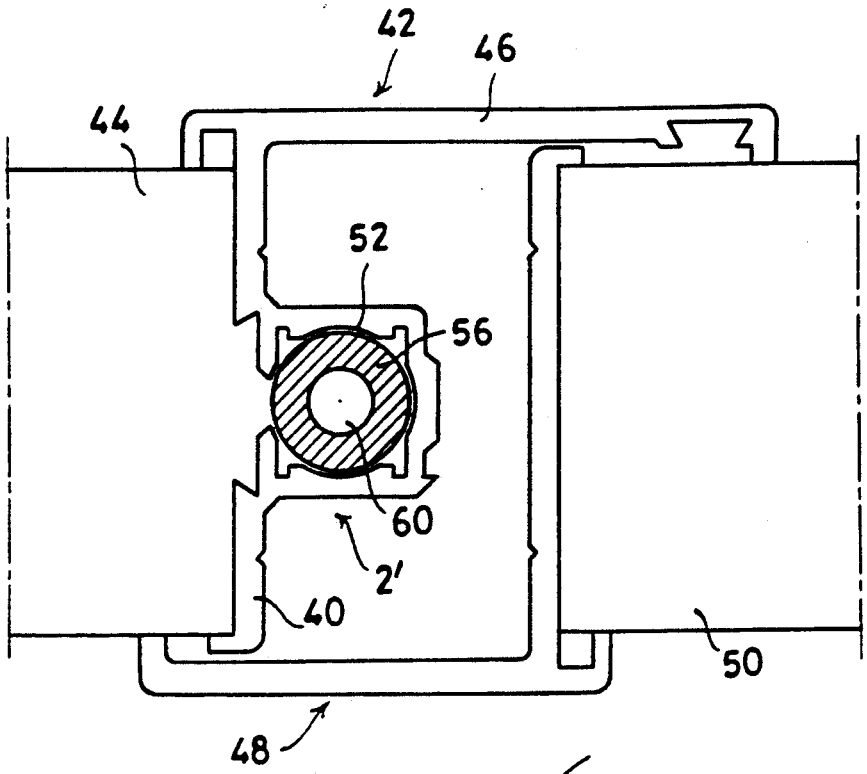
FIG. 4 is a cross-section of a section according to the invention, provided with a cylindrical locking pin.
Figure 5:
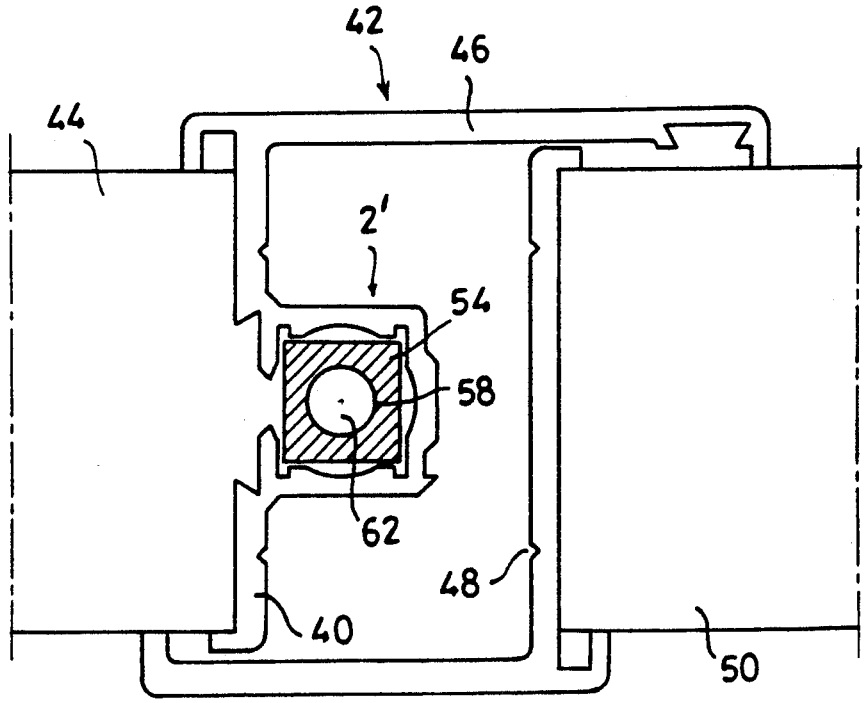
FIG. 5 shows the same cross-section but now with a square locking pin.

FIG. 3 shows in perspective a housing 2', designed as described above, but in this case accommodated in the body part 40 of the door pin section 42 which in the usual manner is composed of this body part fixed against the end face of a door or panel 44 and the flange 46 standing at right angles thereto. Such a section is known, for example, from Dutch Patent Specifications 140316 and 148678. FIG. 3 shows an "empty" housing, while FIG. 4 shows in cross-section how in the door pin section 42—which interacts in the known manner with a second door pin section 48 fixed on the end edge of the door or the panel 50—the housing 2' thereof has a cylindrical locking pin 52. FIG. 5 shows how a square locking pin 54 can be accommodated in this same housing 2', instead of a cylindrical locking pin. In both cases the locking pin is preferably designed with a central longitudinal holes 56, 58, in which a hardened steel pin 60, 62 is fixed. This pin is of such length that in the closed position in the part of the locking pin projecting above the section pin a part of the pin is still present. This has two advantages: on the one hand, forcing of the lock by sawing through the locking pin becomes impossible and the resistance to wrenching becomes greater and, on the other, the section pin no longer needs to be made to size in the workshop; it is sufficient to supply the user with a section with locking pin slightly longer than the expected working height and also without steel insert pin, then to make the section to size, and thereafter to fit the hardened pin.

Figure 6:
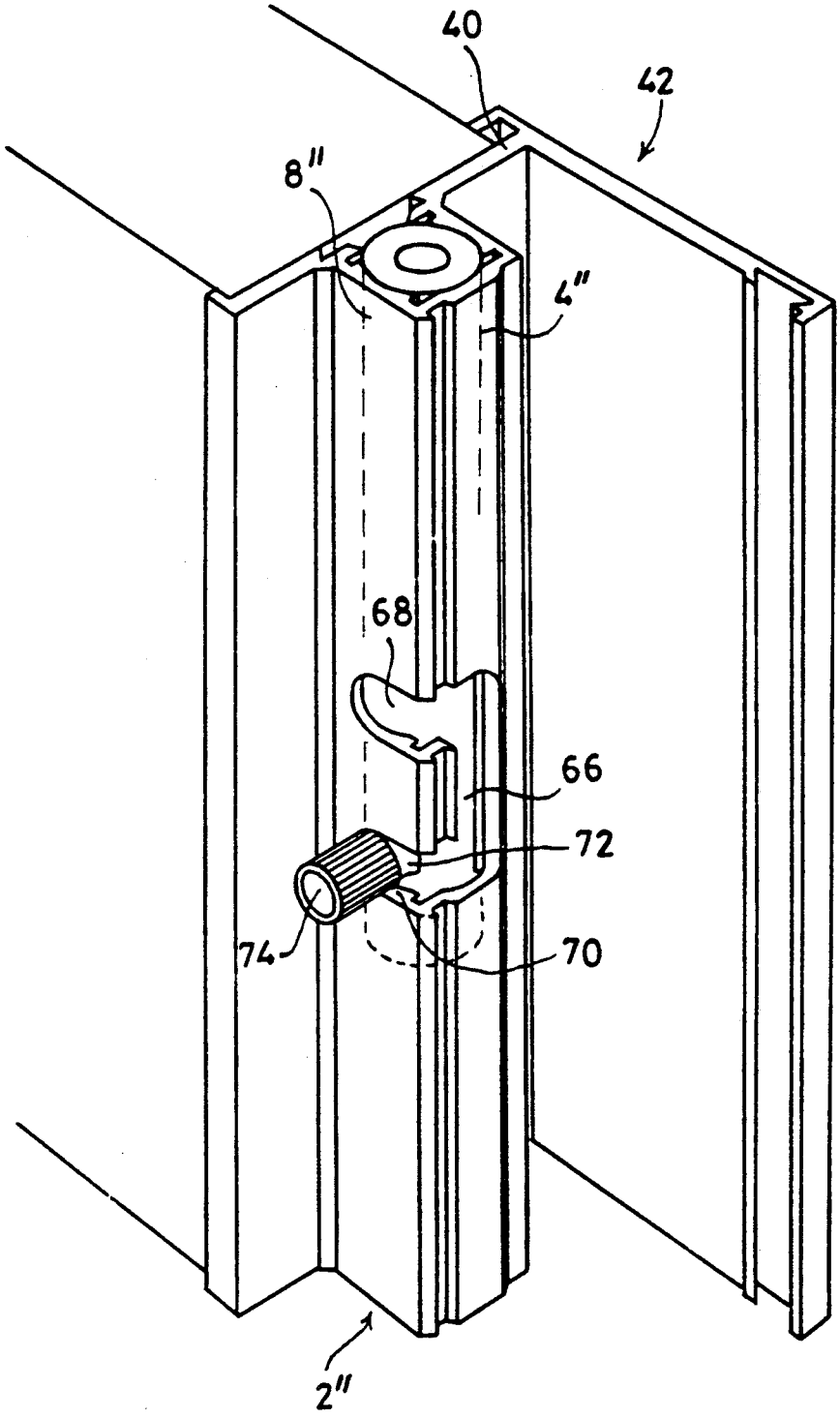
FIGS. 6 and 7 show perspective views of a section provided with a locking pin and its catch.
Figure 7:
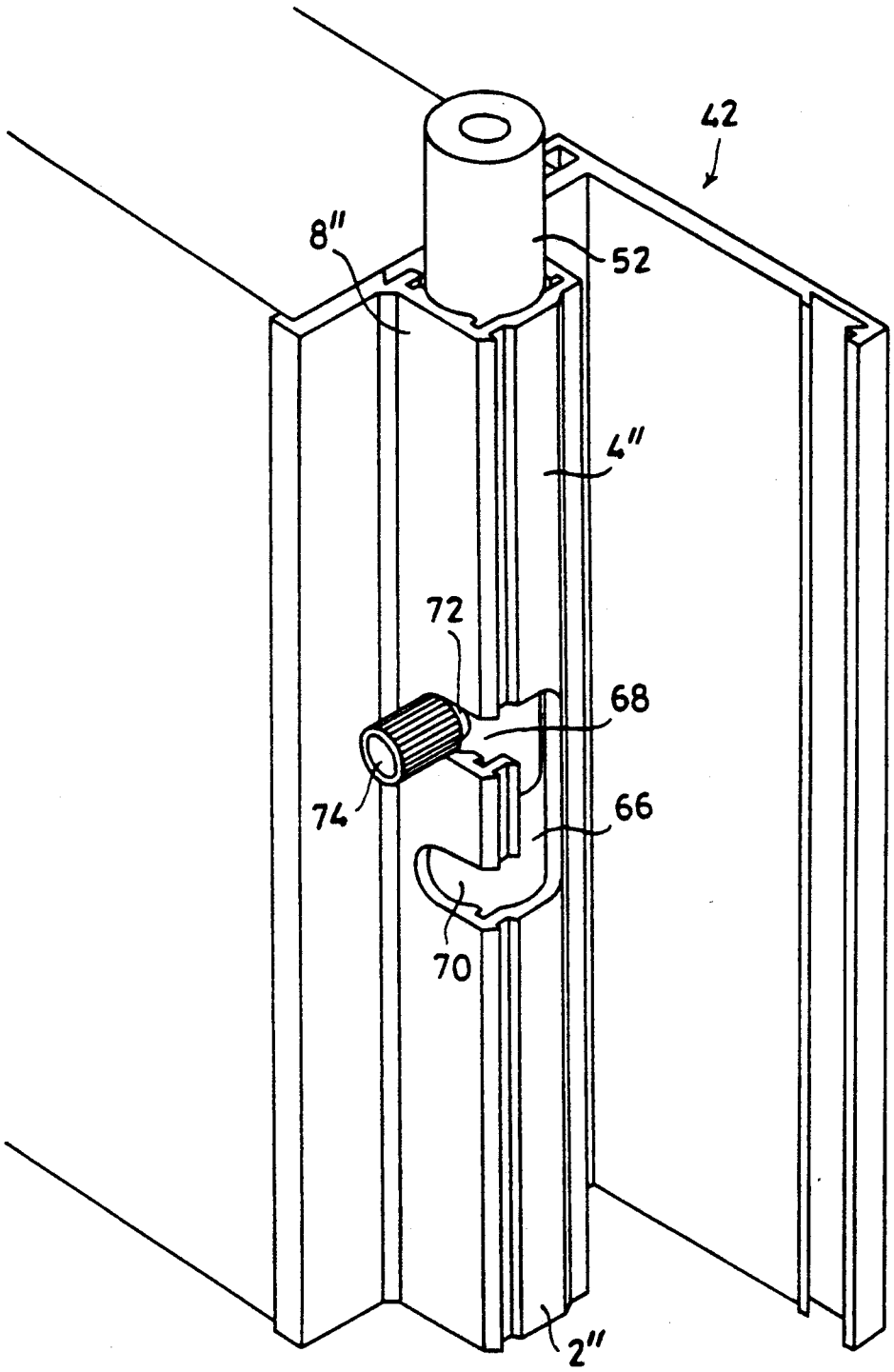
Figure 8:
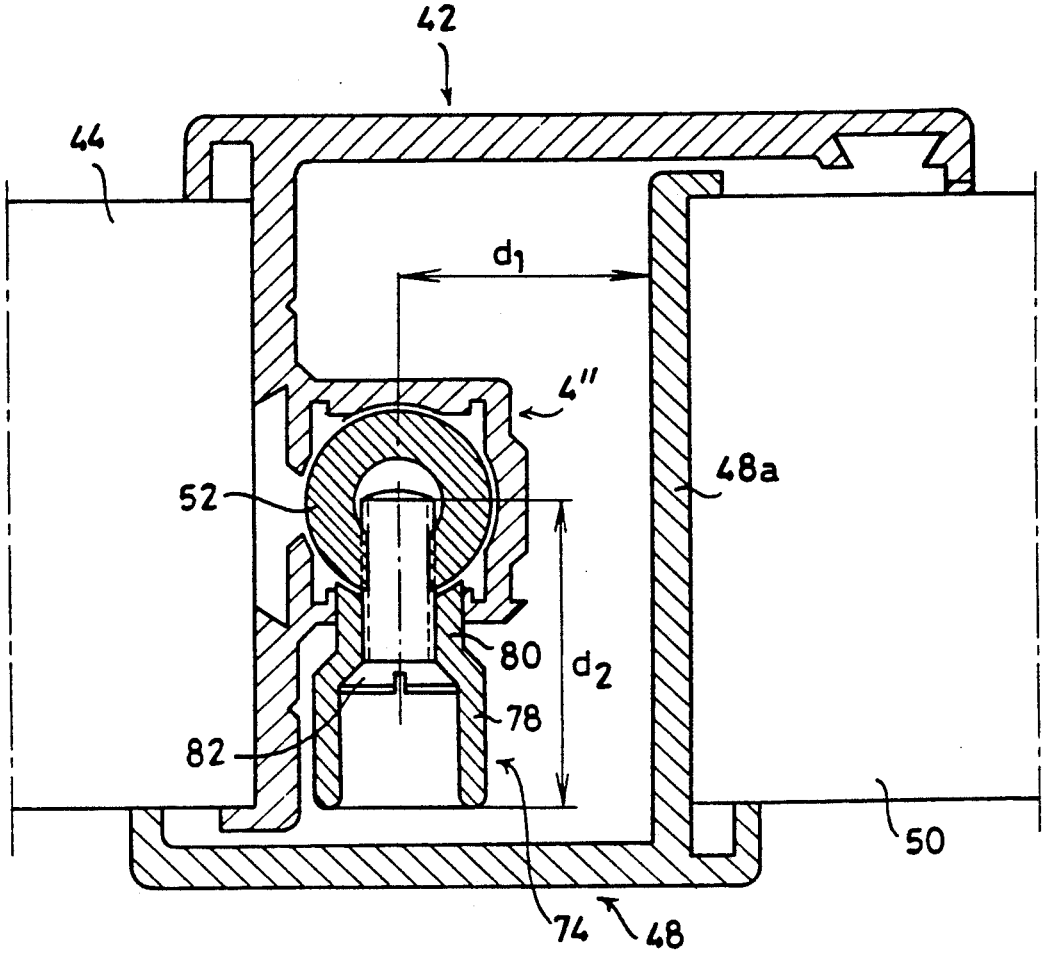
FIG. 8 is a cross-section showing a preferred embodiment of the locking pin and the catch.
Figure 9:
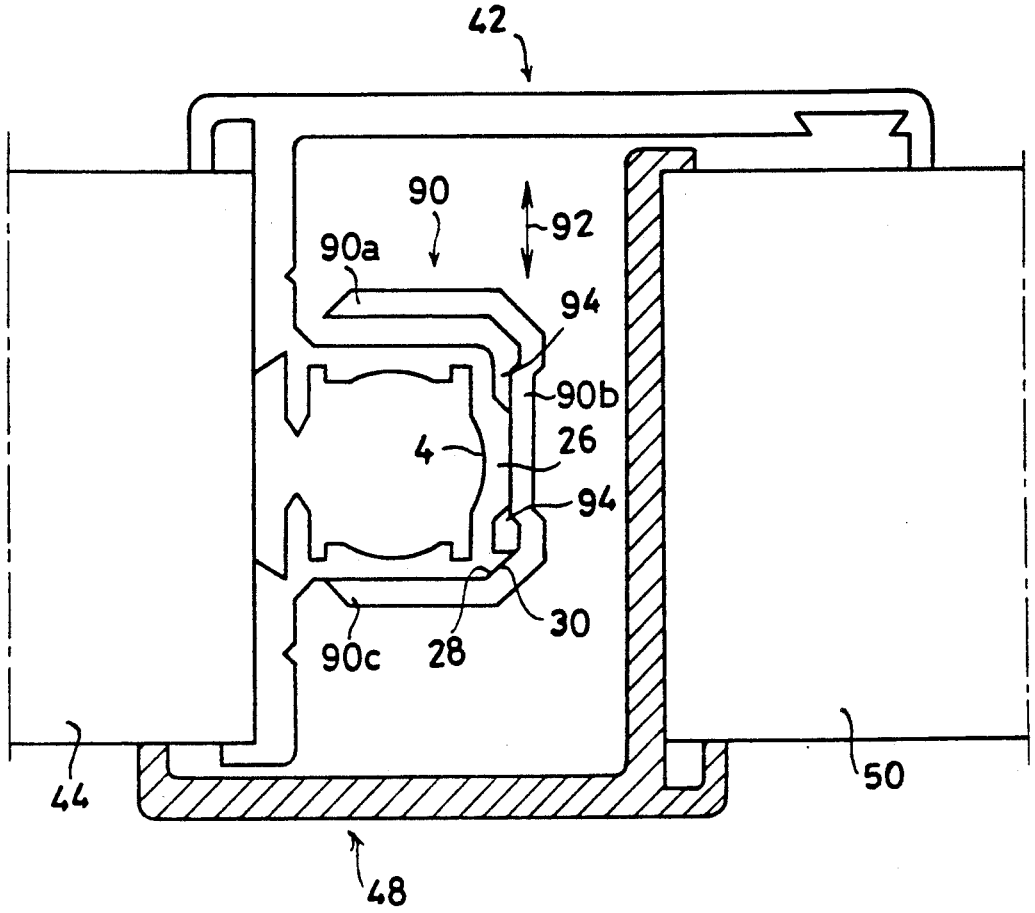
FIG. 9 shows the use of the section according to the invention combined with a closing plate.

It must, of course, be possible to move a locking pin of the type described above in the lengthwise direction of the housing and to fix it in at least one locking position. FIGS. 6, 7 and 8 show how the housing according to the invention can be made suitable for this in a particularly simple manner.

The housing 2'', here again forming part of the body 40 of a door pin section 42, is to this end provided with a recess 66 running in the lengthwise direction of the housing, formed in the body part 4'' with two reassess 68, 70 at right angles thereto formed in the leg 8''. A cylindrical catch 72, which is fixed to the locking pin 52 and bears a control button 74, fits into these recesses. The way in which it works can be seen from FIGS. 6 and 7: When the catch 72 is in the lower recess 70 (situation shown in FIG. 6) the locking pin is recessed completely in the housing 2''; turning the locking pin through 90° to the right, and pressing it upwards and turning it back into the recess 68 produces the position shown in FIG. 7, in which the locking pin projects from the housing 2'' and can perform its locking function.

It can be seen immediately from the figures that the distance which the locking pin 52 can project from the housing is determined by the distance between the recesses 68 and 70, and this distance can be selected fairly arbitrarily. In this way the closure can be used adapted to all circumstances (for example, thickness of floor covering or doors whose bottom edges lie at a distance from the floor covering).

It is also impossible in the case of this closure to move the locking pin down using a tool inserted between the top side of the door pin section and the rebate.

If necessary, one (top) transverse recess would suffice.

In most cases the lock according to the invention will be used in a door or panel which interacts with a second door or panel lying opposite, thus in the situation shown in FIGS. 4 and 5 and also in FIG. 8. This figure also shows a particularly simple fastening of the control button 74, which is designed with a widened end part 78 which passes into a narrower part 80 and is fixed by means of the screw 82 in the pin 52. The head of the screw 82 fits closely into the widened part 78 and the shank of the screw fits into the narrowed part 80; in this way the button 74 is fixed securely on the locking pin 52 so that it is difficult to remove. The part 80 in this case thus fulfills the function of the catch 72 in FIG. 7.

By now ensuring that the distance d2 between the center of the locking pin 52 and the end edge of the button 74 is greater than the distance d1 between the center of the locking pin and the outside of the body 48*a* of the door pin section 48, it is ensured that the door or the panel 50 cannot be closed—thus taken into the position shown in the drawing—until the button 74 is taken either into the recess 70 or into the recess 68 (thus the locked position of the panel 44). This provides additional security while it is also impossible —something which is very important—to turn the locking pin 52 far enough from the outside for the catch 72 or the sleeve part 80 to come out of the recess 68.

Where two doors or panels interact, one of them will in general be provided with a lock with day and night bolt having to interact with elements on or of the section of the panel lying opposite. In the discussion of FIG. 2 it was already pointed out that the back part 4 of the section is designed with a raised part 26 and that the end edge 28 provided with the chamfer 30 is a continuation of the leg 8. FIG. 8 shows the purpose of these provisions. The raised back part 26 serves to support a U-shaped closing plate 90, and the extended end edge 28 serves to limit the movement of said closing plate in the direction of the arrows 92 through the interaction of said edge with one of the projecting edges 94. The closing plate is fixed by means of selftapping screws (not shown), fixed on the back part 4, while the adjustment takes place if necessary by adjusting screws going through one of the legs 90*a* or 90*c*. The usual recesses for day and night bolt are cut in closing plate and back part.

Figure 10:
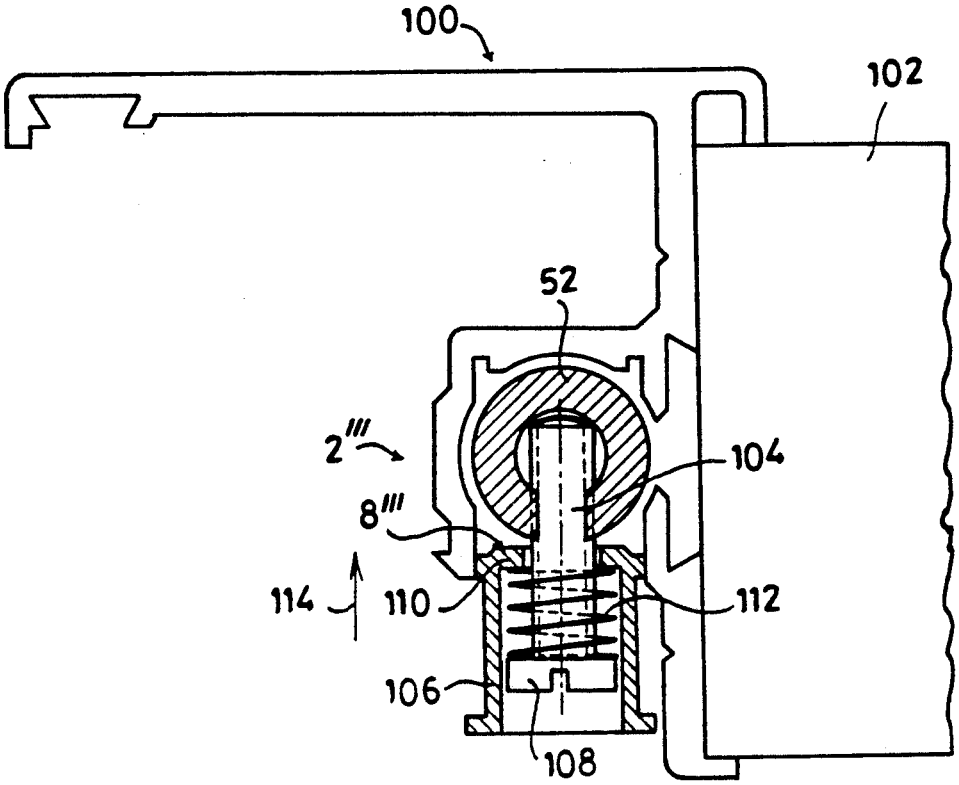
FIG. 10 shows in cross-section another embodiment of the section according to the invention.
Figure 11:
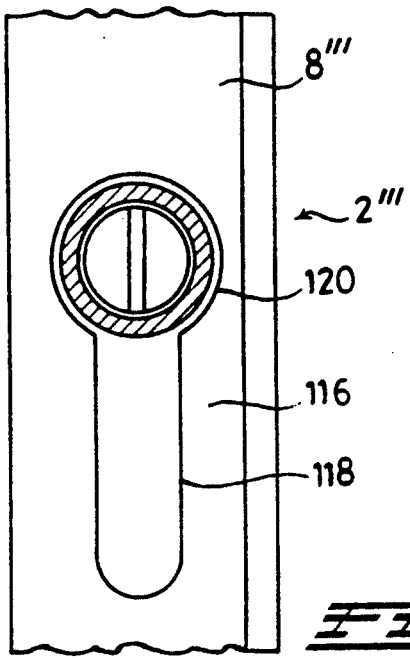
FIG. 11 shows in front view yet another embodiment of the catch used with a locking section.

As FIGS. 10–13 show, the possibilities are not yet exhausted with the embodiments described above. FIGS. 10 and 11 show a housing 2''' containing the locking pin 52, the whole forming part of a door pin section 100 fitted on the panel 102. THe screw 104 is screwed into the locking pin 52 with the sleeve 106 (with the bottom 110) around it; a coil spring 112 is placed between the head 108 of the screw 104 and the bottom 110 of the sleeve 106, so that the sleeve 106 is pressed in the direction of the arrow 114. Formed in the leg 8''' of the housing 2''' is the recess 116, comprising a relatively long part 118 through which the shank of the screw 104 can pass and a round part 120 abutting it and of greater diameter, which can accommodate the bottom 110 of the sleeve 106.

The way in which it works will be clear: in the position shown in FIG. 11 the locking pin 52 is in the highest portion, and the panel 102 is locked; after withdrawal of the sleeve-shaped button 106 in such a way that the bottom 110 comes out of the recess 120, the locking pin can be moved down, and the panel is unlocked. An excellent control is achieved in this way with only a few parts.

These elements can, however, fulfill a security function instead of a control function, namely if the locking pin is remote controlled, for example, by means of an espagnolette. In the position of the sleeve 106 shown in FIG. 11, the pin 52 can be moved downwards only if the sleeve 106 is withdrawn from the recess 120; two hands are thus always needed for opening the lock. This makes the lock burglarproof and childproof.

Figure 13:
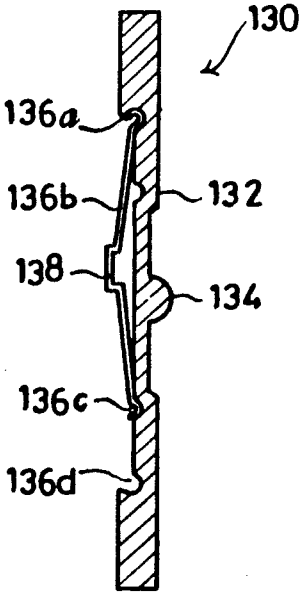
FIG. 13 shows the sliding bolt as used in this embodiment.
Figure 12:
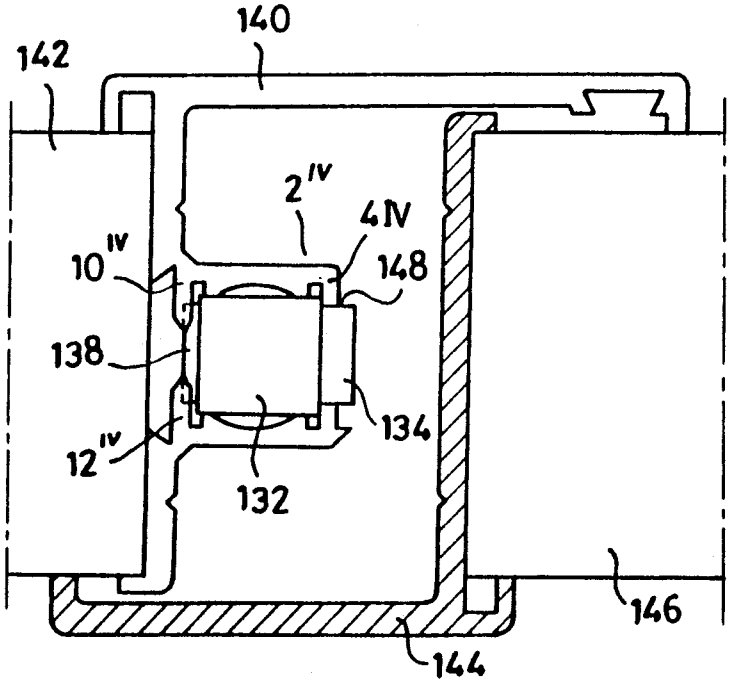
FIG. 12 illustrates in cross-section yet another possibility of using the section according to the invention.

Due to its versatility of potential uses, the section according to the invention is, finally, also suitable for accommodating therein a flush sliding bolt of the type shown in side view in FIG. 13 and indicated there by 130. Such a flush sliding bolt is generally known and is described, for example, in Dutch Patent Specification 1487678 in the name of applicants, and comprises a body part 132 with the control button 134 at one side and at the other side the recesses 136*a*. . . 136*d* which interact with the usual lock spring 138. FIG. 12 shows in cross-section a housing 2'' according to the invention, accommodated in the door pin section 140 which is fitted on the end face of the panel 142 and interacts with the door pin section 144 on the panel 146. The recess 148 for the control button 134 is fitted in the body part 4'', while the recess for the accommodation of the spring 138 is formed in the end edges 10'' and 12'' facing each other.

What is claimed is:

1. A panel section, comprising an elongated housing having a C-shaped cross-section, the C-shaped housing having a main portion and two side legs connected to the main portion thereby forming the C-shaped housing, the two side legs having end edges which face each other and at least partly closing off the C-shaped housing, the C-shaped housing having an interior accommodating a closing element, central parts of inside surfaces of the two side legs, the main portion and the end edges having a surface rounded according to a prescribed radius, adjoining surfaces of said inside surfaces defining corners each comprising a right angle, and further comprising at least one flange extending from the housing adjacent an end edge in a direction opposite said adjacent end edge.

2. Section according to claim 1, wherein a recess is provided in each of the corners, the recess extending into the side legs.

3. Section according to claim 1, wherein the housing has an outside, the outside having a portion projecting outwardly over at least a part thereof until past an end edge of one of the legs, thereby providing a nesting face for a closing plate fitting loosely around the housing, the other of the legs extending outwardly and having a chamfered part providing a stop for said closing plate.

4. Section according to claim 1, wherein a recess extending in a lengthwise direction of said housing is formed in one of the two side legs and main portion to accommodate a catch connected to a closing element to be placed in the housing.

5. Section according to claim 4, wherein the recess extending in the lengthwise direction passes at one end thereof into a locking recess extending at right angles to the lengthwise direction of the housing.

6. Section according to claim 4, comprising two locking recesses situated at a distance from each other in the lengthwise direction of the housing; and interconnected to each other by said recess.

7. Section according to claim 4, wherein the catch projects from the lengthwise extending recess, the catch projecting from the recess having a length, the length of the catch projecting from the recess being greater than a distance between said housing and an end edge of another panel situated opposite the housing when the panel is disposed adjacent said other panel in a position whereby said two panels are in a closed condition.

8. Section according to claim 1, wherein the closing element comprises a locking pin comprising a hollow bushing having a core disposed in an interior of said hollow bushing, the core comprising a hard material.

9. Section according to claim 1, wherein said closing element comprises a locking pin accommodated in said housing, a catch being fastened directly to the locking pin and two locking recesses being provided at a distance from each other in a lengthwise direction of the section, interconnected by a guide recess, the guide recess accommodating the catch.

10. A panel section, comprising an elongated housing having a C-shaped cross-section, the C-shaped housing having a main portion and two side legs connected to the main portion thereby forming the C-shaped housing, the two side legs having end edges which face each other and at least partly closing off the C-shaped housing, the C-shaped housing having an interior accommodating a closing element, central parts of inside surfaces of the two side legs, the main portion and the end edges having a surface rounded according to a prescribed radius, adjoining surfaces of said inside surfaces defining corners each comprising a right angle, and further comprising at least one flange extending from the housing adjacent an end edge in a direction opposite said adjacent end edge, said rounded inside surfaces and said right angle corners accommodating a closing element having either a square or a circular cross-section.

11. Section according to claim 10, wherein a recess is provided in each of the corners, the recess extending into the side legs.

12. Section according to claim 10, wherein the housing has an outside, the outside having a portion projecting outwardly over at least a part thereof until past an end edge of one of the legs, thereby providing a nesting face for a closing plate fitting loosely around the housing, the other of the legs extending outwardly and having a chamfered part providing a stop for said closing plate.

13. Section according to claim 10, wherein a recess extending in a lengthwise direction of said housing is formed in one of the side legs and main portion to accommodate a catch connecting to a closing element to be placed in the housing.

14. Section according to claim 13, wherein the recess extending in the lengthwise direction passes at one end thereof into a locking recess extending at right angles to the lengthwise direction of the housing.

15. Section according to claim 13, comprising two locking recesses situated at a distance from each other in the lengthwise direction of the housing and interconnected to each other by said lengthwise extending recess.

16. Section according to claim 13, wherein the catch projects from the lengthwise extending recess, the catch projecting from the recess having a length, the length of the catch projecting from the recess being greater than a distance between said housing and an end edge of another panel situated opposite the housing when the panel is disposed adjacent said other panel in a position whereby said two panels are in a closed condition.

17. Section according to claim 10, wherein the closing element comprises a locking pin comprising a hollow bushing having a core disposed in an interior of said hollow bushing, the core comprising a hard material.

18. Section according to claim 10, wherein said closing element comprises a locking pin accommodated in said housing, a catch being fastened directly to the locking pin and two locking recesses being provided at a distance from each other in a lengthwise direction of the section, interconnected by a guide recess, the guide recess accommodating the catch.

* * * * *